United States Patent [19]

Bliznak

[11] Patent Number: 4,677,992

[45] Date of Patent: Jul. 7, 1987

[54] SMOKING APPARATUS HAVING CONVOLUTED FILTERING/HEAT-REDUCTION PASSAGEWAY

[76] Inventor: Bedrich V. Bliznak, 362 Rindge Ave., Apt. 3B, Cambridge, Mass. 02140

[21] Appl. No.: 828,028

[22] Filed: Feb. 10, 1986

[51] Int. Cl.[4] ..... A24D 3/04

[52] U.S. Cl. ..... 131/209; 131/339

[58] Field of Search ..... 131/201, 203, 207, 209, 131/198.1, 198.2, 339

[56] References Cited

U.S. PATENT DOCUMENTS 34,585 3/1862 Milne ..... 131/198.2

3,662,764 5/1972 Blanco ..... 131/209

3,774,624 11/1973 Fassbender ..... 131/209

3,792,704 2/1974 Frederick ..... 131/209

*Primary Examiner*—V. Millin

*Attorney, Agent, or Firm*—Donald W. Meeker

[57] ABSTRACT

A filtering/heat-reduction smoking apparatus for various tobacco products. A convoluted passageway in the apparatus removes tar and other harmful chemicals and reduces the heat of the smoke thereby increasing the user's pleasure. Air intake holes also aid in reducing heat. The design requires the smoke to travel through a convoluted passageway many times greater than the length of the apparatus. The apparatus disassembles quickly and easily for cleaning.

13 Claims, 7 Drawing Figures

SMOKING APPARATUS HAVING CONVOLUTED FILTERING/HEAT-REDUCTION PASSAGEWAY

DESCRIPTION

BACKGROUND OF THE INVENTION

TECHNICAL FIELD

The present invention relates to a smoking apparatus which reduces tar and other chemical intake into the lungs, which may cause lung damage and cancer, and in particular to a smoking apparatus having a convoluted pathway and filtering means through which the smoke passes thereby cleaning the smoke and reducing the heat of the smoke before inhalation by the smoker.

BACKGROUND ART

It has been demonstrated in medical and scientific studies and the fact is widely accepted that smoking irritates human tissues and leads to harmful affects. Because of the habit-forming nature of smoking tobacco products and the strong social pressures to conform, it is difficult for people to give up smoking or refrain from taking up the habit in the first place. Therefore a safer more pleasant means to permit smoking is desirable.

Various holders for cigarettes and cigars, filtered cigarettes and liquid cooling means for pipes have been used in the past with only moderate success. Generally the filtering pathway is very short and only partially filters the smoke, with little or no cooling of the smoke. Or the liquid cooling means is a cumbersome device which is not transportable for people to take with them in the course of daily routines. None of the prior art provides an adequate means for filtering and cooling the smoke simultaneously in a device which is transportable in the pocket of a smoker, convenient to use and applicable to smoking of a pipe, cigar, or cigarette.

DISCLOSURE OF INVENTION

This invention relates to a smoking apparatus which reduces tar and other chemical intake into the lungs, which may cause lung damage and cancer.

This invention also results in a cooler, cleaner smoke for pipes, cigars, and cigarettes inclusive, with less bite, and more flavorable and aromatic smoke.

I developed this invention from observations during my childhood in Czechoslovakia. I would see the older people of my community (80–90 years old) smoking long (approx. 3 feet long) pipes. These elders of my community lived very long lives, were in excellent health, and enjoyed a pleasurable, cleaner smoke compared to today's standards. I discovered that this was related to the distance that the smoke travelled before entering the lungs and mouth; i.e. it had a chance to displace the heat and some of the harmful chemicals.

This memory led me to develop and perfect this smoking apparatus, which emulates this long pipe described above. In this device, the smoke travels spirally around the inside of the stem for a distance of approximately 33.5 inches (or 850 mm), and results in a cooler, cleaner smoke. This smoke travels up the pipe from the bowl, through a spiral, reverses direction, and spirals back down the pipe, then enters a filter and travels back up, to the mouthpiece, resulting in lower tar, lower chemical intake, which if not filtered out, as in this apparatus, could impair one's health, as well as make a harsh, unpleasant smoke.

I have personal experience with the use of this smoking apparatus, with great success. In smoking a pipe of today's market, I would have pains in my stomach, due to an ulcer. Upon using my smoking apparatus, the pains vanished. This is a result of the lower tar and harmful chemical intake.

BRIEF DESCRIPTION OF THE DRAWINGS

These and other details and advantages of my invention will be described in connection with the accompanying drawings, which are furnished only in illustration, and in which drawings.

DETAILED DESCRIPTION OF THE INVENTION

Figure 1:
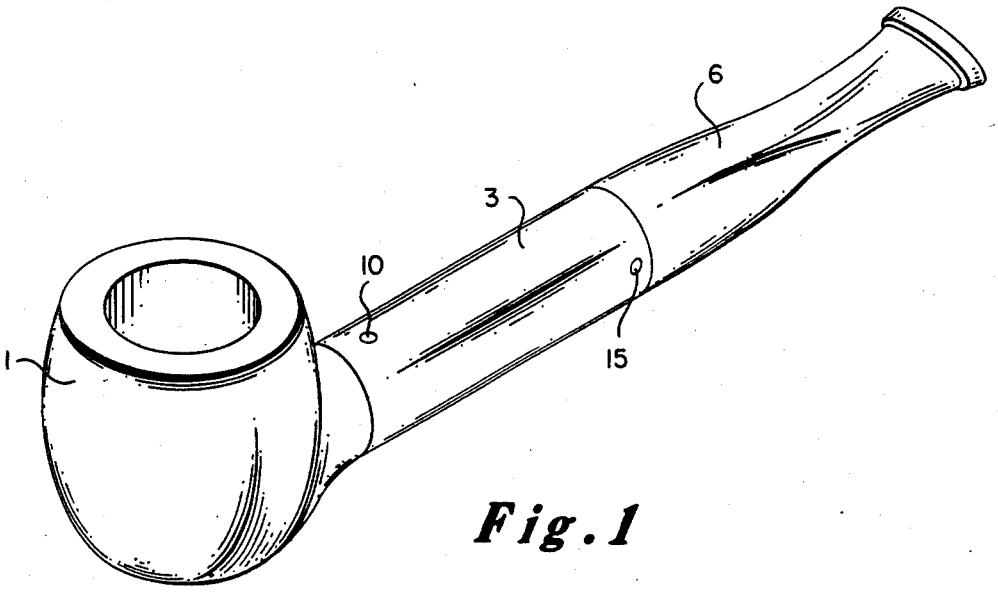
FIG. 1 is a perspective view of the pipe with smoking apparatus.

Referring to FIG. 1, this shows the perspective view of the invention used as a pipe with bowl 1, tubular casing 3 and mouthpiece 6.

Figure 2:
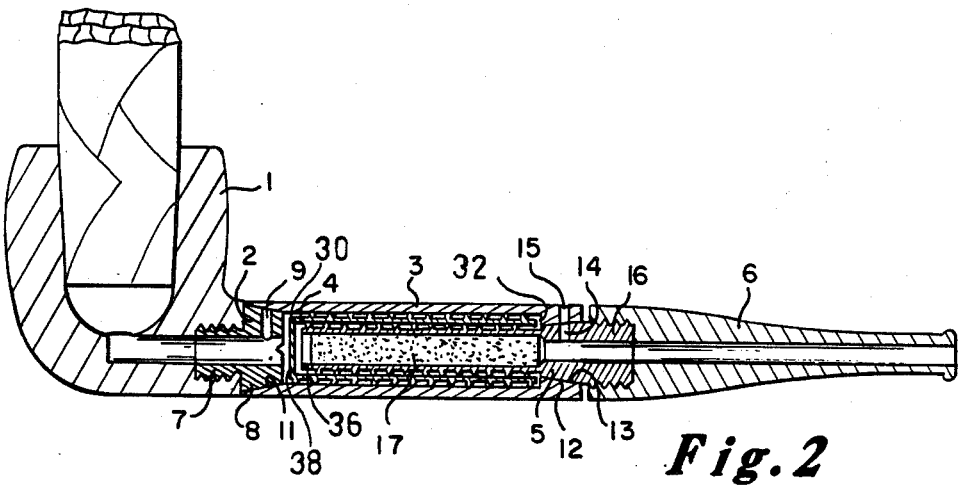
FIG. 2 is a cross-sectional view of the smoking apparatus with a cigar.
Figure 3:
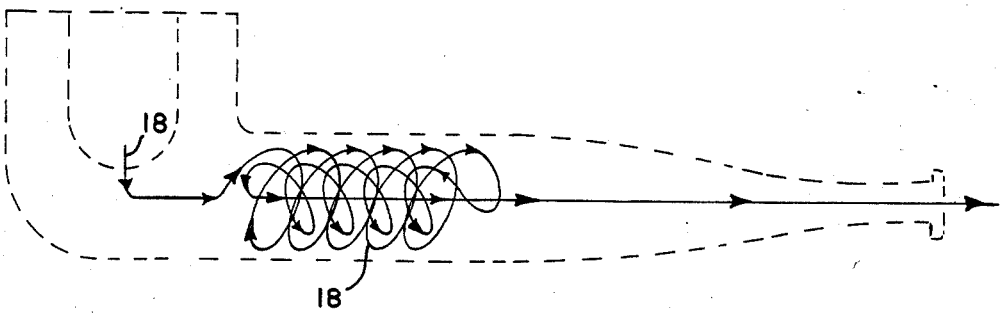
FIG. 3 shows direction in which the smoke travels.

FIG. 2 shows the bowl 1 holding a cigar section. The operation of the invention is the same irregardless of the type of tobacco product used.

Figure 4:
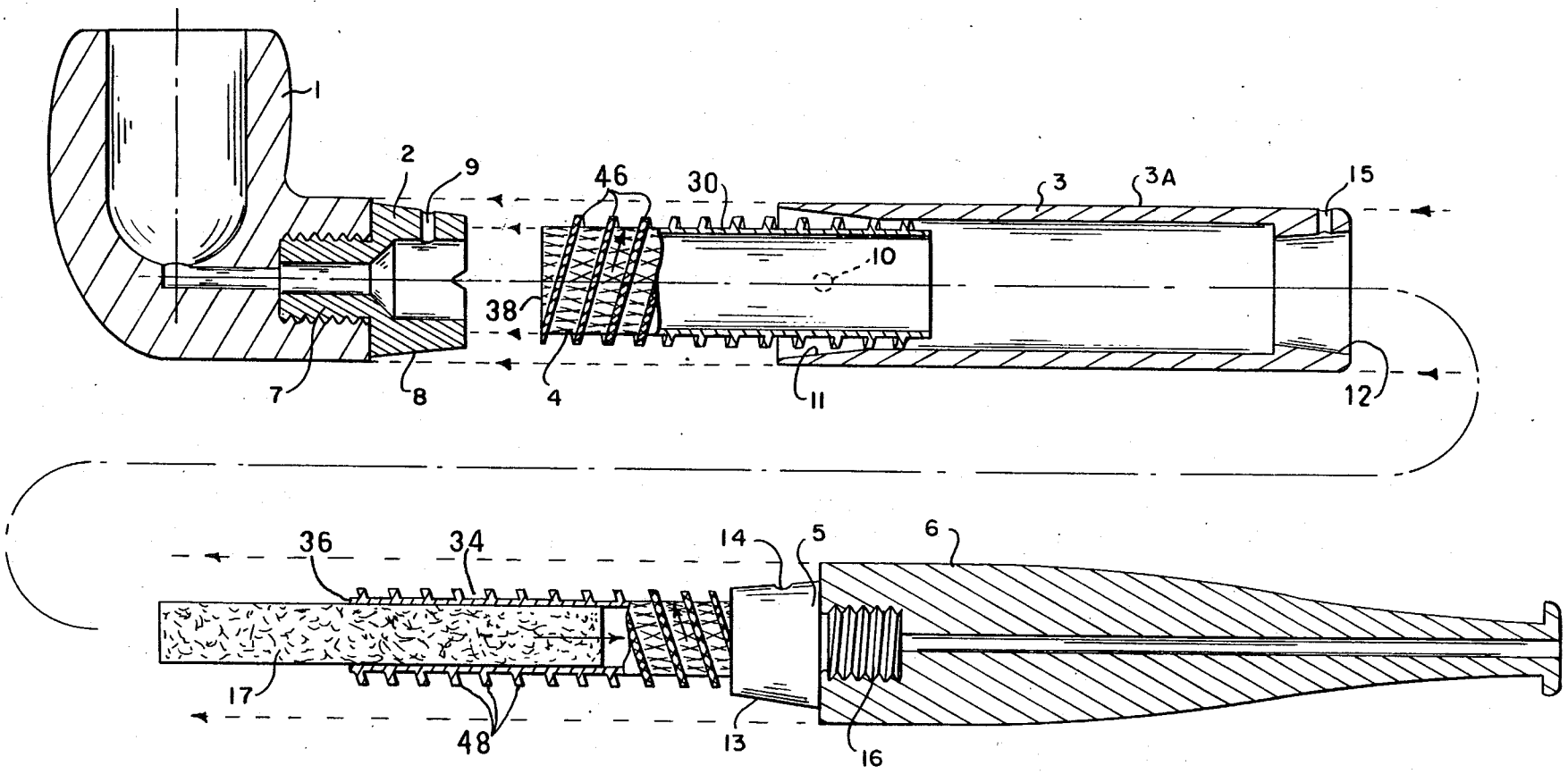
FIG. 4 shows cooler, filter, from pipe to mouthpiece, in two separate sections

FIGS. 2 and 4 show the operation of the preferred embodiments used. The connector 2 holds the bowl 1 in place with threads 7. The connector 2 is secured to the tubular casing 3 by the mating of taper 8 and taper 11. Any variation of the connector 2 which securely attaches the bowl 1 and tubular casing 3 is acceptable.

Holes 9 and 10 and holes 14 and 15 align to provide intake air. These holes can be regulated as to degree of opening by turning the tubular casing 3 to allow more or less air to mix with the smoke. This allows the user to obtain the desired mixture of smoke and air.

Because the end of hollow cylinder 30 closest to the bowl 1 is sealed by disc 38, the smoke travels towards the mouthpiece 6 along the convoluted passageway 4 created by the spiral ridge 46 protruding from the outer surface the first of hollow cylinder 30 and the interior surface of the tubular casing 3 until it reaches protrusion 32 of the tubular casing 3. The smoke must then travel towards the bowl 1 along the convoluted passageway 34 created by the spiral ridge 48 protruding from the outer surface of the second hollow cylinder 36 and the interior surface of the first hollow cylinder 30. It is also possible to have just the first hollow cylinder 30, this embodiment is not shown. The smoke travels to the end of the convoluted passageway 34 where its movement in this direction is stopped by disc 38. The smoke must then reverse direction a second time and travel through filter 17. Filter 17 is removable inserted into the second hollow cylinder 36.

The treated smoke then reaches the mouthpiece which is secured to the connector 5 by threads 16. The connector 5 is secured to the tubular casing 3 by the mating of taper 12 and taper 13. Any variation of the connector 5 which securely attaches the mouthpiece 6 to the tubular casing 3 is acceptable.

By design, the invention requires the smoke to travel a distance much greater than the length of the tubular casing 3. This gives the smoke more time and distance to cool down and requires the smoke to pass out over a greater surface area to allow a greater amount of tar and other harmful chemicals to be removed. The preferred material should be non-corrosive, easy to clean and disipate heat quickly to ensure a more effective reduction of tar and harmful chemicals.

The design also allows quick and easy disassembly of the elements for cleaning.

To enhance the removal action, the convoluted passageways 4 and 34 can be knurled to increase the surface area. This embodiment is not shown.

The filter 17 is composed of a material or materials which trap tar and other hazardous chemicals and juices. This material can also be absorbent to soak up a flavoring liquid, such as brandy or cognac, to flavor the smoke if desired.

FIG. 4 shows an embodiment of the tubular casing 3A wherein the exterior surface is knurled to enhance the cooling of the smoke.

Figure 5:
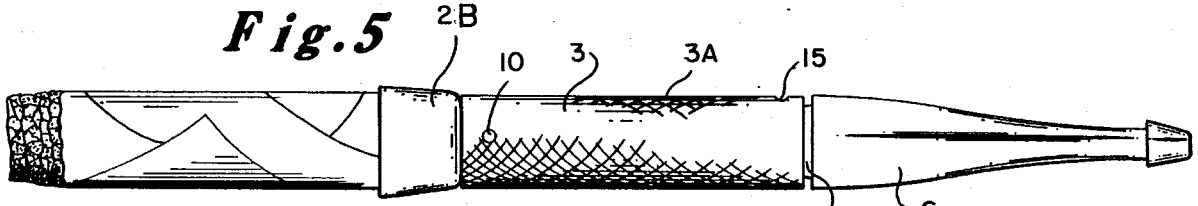
FIG. 5 shows outside view of apparatus for smoking cigars.
Figure 6:
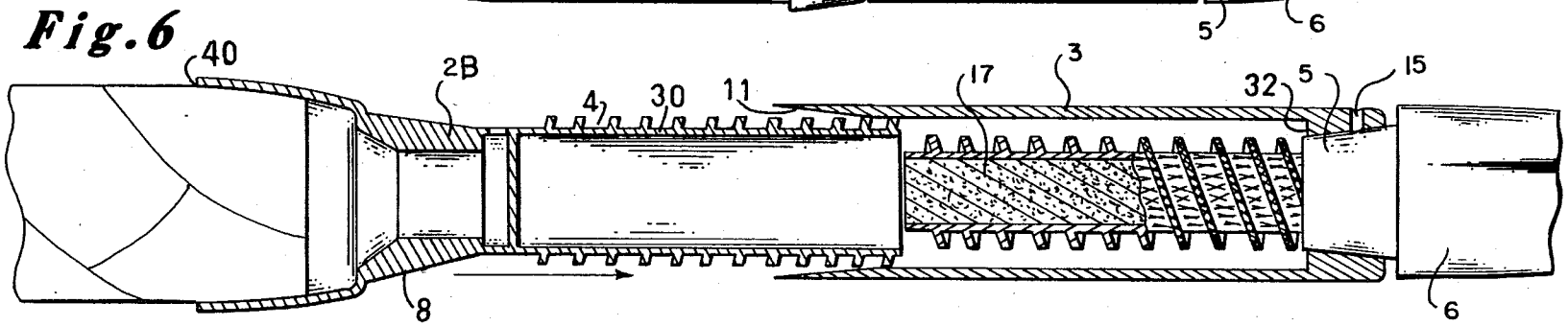
FIG. 6 shows a cross-sectional enlarged view of the smoking apparatus for cigars.

FIGS. 5 and 6 show an alternate embodiment wherein the invention is used with a cigar. The connector 2B is designed with taper 8 which mates with taper 11 to secure the connector 2B to the tubular casing 3. Any comparable securing means is also acceptable. The cigar holder 40 portion of connector 2B has a tapered interior to allow it to hold cigars of varying diameters. The remaining elements operate as previously described.

Figure 7:
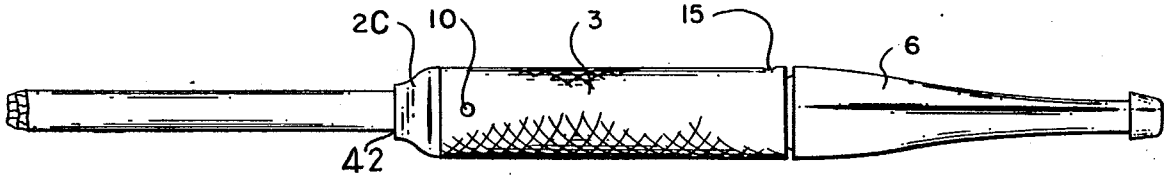
FIG. 7 shows a view of the smoking apparatus holding a cigarette (smaller holder).

FIG. 7 shows an alternate embodiment wherein the invention is used with a cigarette. The connector 2C is securely connected to tubular casing 3, which houses a comparable double cylinder and filter creating a convoluted passageway for filtering and cooling the smoke. Air intake holes 10 and 15 (which can be regulated by opening and closing as in the case of the other embodiments) and knurlings on the casing further aid in cooling the smoke. The connector 2C is fitted with an opening 42 for holding a cigarette therein. The mouthpiece 6 is comparable to those of the other embodiments.

The cylinders comprising the convoluted passageway may be fabricated in a number of ways including machining (cutting), cold pressing, soft formed from aluminum, or heat formed from a metal powder using a scintering process in a nitrogen furnace. An aluminum alloy is preferred as the material because of its light weight, strength, high heat transfer properties, non-corrosive properties and ability to be anodized in any color.

A long convoluted passageway with knurlings and effective filter with aluminum walls and air intake holes combine to create an effective means to cool the smoke and filter tar, nicotine, pesticides, and other chemicals from the smoke.

It is understood that the preceding description is given merely by way of illustration and not limitation of the invention and that various modifications may be made without departing from the spirit of the invention as claimed.

I claim:

1. A smoking apparatus having a long convoluted passageway thhrough which smoke must travel for filtering and heat reduction, wherein the smoking apparatus comprises:

an elongated separable tubular casing;

removably attached to one end of the tubular casing, a means for receiving and holding a burning tobacco product;

removably attached at an opposite end of the casing, a mouthpiece for drawing smoke from the burning tobacco product into a user's mouth;

intermediate of the two ends a convoluted passageway through which smoke from the burning tobacco product passes en route to the user's mouth, wherein the passageway comprises at least one elongated member having a series of disconformities along its surface, which disconformaties create a passageway through which the smoke passes in a substantially spiraling pattern;

wherein the convoluted passage comprises within the casing a first cylinder slightly smaller in diameter than the casing, wherein the cylinder along its length on an exterior surface comprises a spiral ridge protruding from the outer cylinder into contact with the casing to form a spiral passageway therebetween;

wherein the first cylinder is hollow and sealed on the end which adjoins the means for receiving and holding the burning tobacco product and the convoluted passageway further comprises a second cylinder slightly smaller in diameter than the first cylinder and fitting within the first cylinder with a small space therebetween, wherein the second cylinder along its length on an exterior surface comprises a spiral ridge protruding from the second cylinder into contact with the first cylinder thereby forming a spiral passageway therebetween;

wherein the second cylinder is hollow and the convoluted passageway further comprises a filter made of an absorbant material which is snugly inserted into the second cylinder.

2. The invention of claim 1 wherein the surface of the convoluted passageway is knurled to trap tar and harmful chemicals that are in the smoke.

3. The invention of claim 1 wherein the means for receiving and holding the burning tobacco product comprises a bowl which receives and holds the tobacco product and the bowl further comprises a hollow passageway which connects to the convoluted passageway.

4. The invention of claim 3 wherein the bowl is designed to hold a loose tobacco product.

5. The invention of claim 3 wherein the bowl is designed to hold a rolled tobacco product.

6. The invention of claim 1 wherein the means for receiving and holding the burning tobacco product is a holder which comprises a hollow cylinder whose interior both connects to the convoluted passageway and is tapered to receive a rolled tobacco product.

7. The invention of claim 1 wherein the tubular casing further comprises an adjusted hole which acts as an adjustable air vent.

8. The invention of claim 1 wherein the exterior surface of the tubular casing is knurled.

9. A smoking apparatus having a long convoluted passageway through which smoke must travel for filtering and heat reduction, wherein the smoking apparatus comprises:

an elongated separable tubular casing which has an adjustable air vent;

removably attached at one end of the tubular casing, a means for receiving and holding a burning tobacco product;

removably attached at an opposite end of the casing, a mouthpiece for drawing smoke from the burning tobacco product into a user's mouth;

intermediate of the two ends a knurled convoluted passageway through which smoke from the burning tobacco product passes en route to the user's mouth, wherein the passageway comprises:

a first hollow cylinder sealed on the end which adjoins the means for receiving and holding the burning tobacco product, slightly smaller in diameter than the casing, wherein the first cylinder along its length on an exterior surface comprises a knurled spiral ridge protruding from the first cylinder into contract with the casing to form a knurled spiral passageway therebetween;

a second hollow cylinder slightly smaller in diameter than the interior diameter of the first cylinder wherein the second cylinder along its length or an exterior surface comprises a knurled spiral ridge protruding from the second cylinder into contact with the interior of the first cylinder thereby forming a knurled spiral passageway therebetween;

a filter snugly inserted into the second cylinder.

10. The invention of claim 9 wherein the means for receiving and holding the burning tobacco product comprises a bowl which receives and holds the tobacco product and the bowl further comprises a hollow passageway which connects to the convoluted passageway.

11. The invention of claim 9 wherein the means for receiving and holding the burning tobacco product is a holder which comprises a hollow cylinder whose interior both connects to the convoluted passageway and is tapered to receive a rolled tobacco product.

12. The invention of claim 9 wherein the filter is made of an absorbent material which can be soaked in a flavoring liquid.

13. The invention of claim 9 wherein the exterior surface of the tubular casing is knurled.

* * * * *